United States Patent [19]

Obrecht

[11] Patent Number: 4,694,914

[45] Date of Patent: Sep. 22, 1987

[54] DRILLING STRING FOR DRILLING A BENT BORE, A METHOD OF USING SAID STRING, AND A BENDING DEVICE USED IN SAID STRING

[75] Inventor: Georges Obrecht, Seyssins, France

[73] Assignee: Alsthom, Paris, France

[21] Appl. No.: 888,664

[22] Filed: Jul. 23, 1986

[30] Foreign Application Priority Data

Jul. 30, 1985 [FR] France ..... 85 11608

[51] Int. Cl.[4] ..... E21B 7/08

[52] U.S. Cl. ..... 175/61; 175/74; 175/256

[58] Field of Search ..... 175/45, 61, 62, 73, 175/74, 256

[56] References Cited

U.S. PATENT DOCUMENTS

| | | | |
|---|---|---|---|
| 3,841,420 | 10/1974 | Russell | 175/45 |
| 4,076,084 | 2/1978 | Tighe | 175/73 |
| 4,077,657 | 3/1978 | Trzeciak | 175/61 |
| 4,220,214 | 9/1980 | Bonoit | 175/74 |
| 4,286,676 | 9/1981 | Nguyen et al. | 175/74 |
| 4,303,135 | 12/1981 | Bonoit | 175/73 |
| 4,319,649 | 3/1982 | Jeter | 175/73 |
| 4,374,547 | 2/1983 | Nguyen et al. | 175/74 |
| 4,465,147 | 8/1984 | Feenstra et al. | 175/73 |
| 4,577,701 | 3/1986 | Dellinger et al. | 175/61 |

FOREIGN PATENT DOCUMENTS

| | | | |
|---|---|---|---|
| 0085444 | 10/1983 | European Pat. Off. . | |
| 3326885 | 8/1984 | Fed. Rep. of Germany . | |
| 2143879 | 2/1985 | United Kingdom | 175/61 |

*Primary Examiner*—Stephen J. Novosad
*Assistant Examiner*—Terry Lee Melius
*Attorney, Agent, or Firm*—Sughrue, Mion, Zinn, Macpeak & Seas

[57] ABSTRACT

The present invention relates to drilling a well with a bent bore. A bending device is inserted in a drilling string between a stabilizer and an active motor element. If the drilling string is rotated in one direction the bending device takes up a rectilinear configuration for ensuring rectilinear drilling, and if the drilling string is rotated in the opposite direction it takes up a bent configuration, thereby transforming itself into a bent coupling for curved drilling. The device comprises two superposed sleeves (1, 2) one of which is capable of rotating through a limited angle about a pivot (3) whose axis lies at the same small angle (A) to the axes (10, 10A) of both sleeves. The invention is applicable to drilling oil wells or geothermal wells.

4 Claims, 5 Drawing Figures

DRILLING STRING FOR DRILLING A BENT BORE, A METHOD OF USING SAID STRING, AND A BENDING DEVICE USED IN SAID STRING

The present invention relates to underground drilling.

BACKGROUND OF THE INVENTION

It is more particularly applicable to exploring or exploiting underground reservoirs of oil or gas, or of hot or cold water, in circumstances which make it impossible or unadvisable to reach the underground target point by means of a rectilinear well (whether vertical or sloping). An underground obstacle, even if known about in advance, may lead to the inclincation or azimuth, for example, of a well being changed at a point situated at some depth below the surface. The same applies when a length of the drilled well is to run along a shallow stratum which may slope to a greater or lesser extent or which may be horizontal.

In such cases, bends in the well must be included in the original drilling plan.

In addition, even when drilling vertically, it may happen that the rocks which are encountered cause an unwanted deflection of the drilling axis.

Such an unwanted deflection must be compensated by a deliberate deflection which may be referred to as a "correction bend". Regardless of the reason which makes such operations necessary, bending operations begin with the operation of measuring the inclination and the azimuth or bearing angle of the axis of the portion of the well being drilled, and also the position which has been reached, which measurement is the result of "dead reckoning" based on the lengths, the slopes, and the bearings, of all the lengths of the well drilled so far. Once these measuring operations have been performed, a bend needs to be made. A drilling method for making such a bend comprises a succession of distinct drilling stages, namely at least one stage of curved drilling together with a plurality of rectilinear drilling stages during each of which a rectilinear length of well is drilled along a rectilinear axis. The, or each, stage of curved drilling is interposed between two stages of rectilinear drilling. While curved drilling is taking place, a curved length of well is drilled having a curved axis which is substantially in the form of an arc of a circle, and this arcuate axis runs on from the axis of the preceding rectilinear length of well. Similarly, the axis of the following rectilinear length of well runs on from the axis of the curved length.

During each of these drilling stages, a drilling tool is used which has an axis running along a top-to-bottom direction (or a back-to-front direction if drilling is taking place horizontally), which tool is suitable for drilling downwardly (forwardly) and optionally sideways into the rock at the bottom end of the well. A bottom motor is fixed above (behind) said tool for driving it and has an axis which lies in the extension of the tool axis. Tubes, known as "drill-stems" in the art, are fixed above (behind) said motor one after the other and constitute a "string" extending to the mouth of the well and serving to convey drilling mud to the bottom of the well under pressure, which mud also provides the energy required for driving the motor. The drilling string is also used for remotely controlling from the surface the pressure with which the tool presses against the rock, for optionally rotating the entire assembly, and for supporting the tool and the motor whenever they are raised or lowered along the well.

(It must be understood that throughout this specification the terms "up" and "down" or "top" and "bottom", etc., may need to be replaced with "backwards" and "forwards" or "back" and "front" etc., respectively, in the event that the well is advancing horizontally).

The drilling stems have axes which extend the motor axis and which extend one another. The number of stems is progressively increased by adding new stems as the well gets deeper. The diameter of the motor and the diameter of the stems are less than the diameter of the normal well as drilled by the tool, and the stems are sufficiently flexible for a drilling string constituted by the above-described components to be capable of following curved lengths of well.

It is known that curved drilling stages can be provided by incorporating a bending device in the drilling string at the top of the down-hole motor which drives the drilling tool. The bending device is a bendable coupling which causes the tool axis to slope relative to the axis of the remainder of the string. The down-hole motor itself may also be bent. Another bending method consists in using excentric stabilizers. Such a stabilizer constitutes at least one asymmetrical radial projection whose end is at a slightly greater distance from the axis of the string than the normal radius equal to one-half of the normal well diameter. It thus presses against the wall of the well being drilled and offsets the axis of the down-hole motor from the axis of the well with the string bending elastically, thereby providing an angular deflection of the drilling direction of the tool relative to the axis of the length of well being drilled, and thus giving said length the desired curved shape.

The down-hole motor is generally a turbine or a Moineau-type motor.

In some known methods, the entire drilling string is raised to the surface each time a rectilinear length is to be drilled beyond a curved length, with the string being raised so that the bending device such as a bent coupling, a bent motor or excentric stabilizers may be removed. Similarly, the entire string must be raised to the surface each time a new bend is to be made since the bending device must then be put back into position. These maneuvers of raising and lowering the drilling string require each of the drilling stems to be successively removed from or added to the string. Such maneuvers thus occupy a major portion of the time required for providing a bend, which time includes the above-mentioned measuring operations and drilling the curved length of well for obtaining the desired change of direction. The time taken constitutes one of the major items in the cost of drilling a well.

In accordance with another known method using excentric stabilizers, a rectilinear length of well is obtained beyond a curved length by rotating the entire string. The tool then drills a hole of enlarged diameter. This method avoids the onerous operation of raising and lowering the drilling string, but it suffers from the drawback of subjecting the down-hole motor to large bending stresses.

This second known method is described, for example, in Shell's European patent application published as EP-A 2, No. 0 085 444.

Other known methods use a controllable bending device, in particular a controllable bend coupling constituting a length of the drilling string just above the down-hole motor. Such a device is controllable to take up a bent configuration during stages for which a bent length of well is being drilled, or a rectilinear configuration during stages for which a rectilinear length of well is being maintained or re-established. The device comprises two successive sleeves capable of pivoting relative to each other about a pivot axis which causes the axes of both sleeves to pivot through the same small angle. Pivoting is controlled either by means of an axial displacement of the top portion of the column or else by means of a pivot motor driving a gear train as described in U.S. Pat. No. 4,303,135 (Benoit).

Such controllable bending devices suffer from the drawback of being complex.

Preferred implementations of the present invention enable curved drilling stages and rectilinear drilling stages to follow one another without losing time and while allowing the drilling tool to operate under good conditions throughout, this being achieved by means of a controllable bending device which is similar than that described in the above-mentioned Benoit patent.

SUMMARY OF THE INVENTION

The present invention provides a drilling string for drilling a bent bore, said string having an axis at all points along its length and comprising:

a rotary drilling tool mounted via a tool shaft to the bottom of the string, said tool having a tool axis which locally constitutes the string axis;

an active element of a down-hole motor driving said tool in rapid rotation relative to said string;

a pivot element of said motor placed between said motor element and said tool and carrying said tool shaft for transmitting axial thrust to said tool from said string while enabling said tool to rotate;

a controllable bending device capable of taking up a bent configuration for locally bending the string in order to provide a curved length of bore, and capable of taking up a rectilinear configuration for re-establishing string rectilinearity in order to provide a straight length of bore; and a succession of drilling tubes for transmitting axial thrust to said pivot element, and for enabling the string assembly to be slowly rotated from the surface of the ground;

said bending device comprising;

a lower sleeve constituting a length of said drilling string above said tool and having an axis which is locally the axis of said string and which is fixed to said tool axis;

an upper sleeve constituting a length of said drilling string above said lower sleeve and having an axis which is locally the axis of said string; and pivot means interconnecting said upper and lower sleeves, said pivot means having a pivot axis which slopes by the same small angle (A) relative to the respective axes of said sleeves and holding said sleeves relative to each other while enabling the lower sleeve to rotate relative to the upper sleeve about said pivot axis, between an "aligned" position of said lower sleeve in which the axes of said sleeves are aligned in order to bring said device to its rectilinear configuration, and a "bent" position of said sleeve creating a bend angle ($D=2\,A\,\sin R/2$) between the axes of said two sleeves bringing the device to its bent configuration, said pivot means allowing a free passage inside the string at least for drilling mud;

said string including the improvement whereby said pivot means of said bending device allow the lower sleeve to rotate only through a limited angular pivot sector (R) about said pivot axis, with said aligned and bent positions being defined by abutments at each end of said sector;

said column including, beneath said bending device and above said tool, a member which rubs against the wall of the well so that rotating said drilling string in a normal direction causes a friction couple to appear which brings the lower sleeve into abutment against said alignment end of the pivot sector, and so that rotation of the drilling string in the opposite direction causes a friction couple to appear which brings said sleeve into abutment with said bending end, means being provided for holding said sleeve against said bending end in the absence of rotation of the string.

In a preferred disposition, said bending device is placed between said motor element and said pivot element and has a coupling passing axially therethrough for transmitting motor drive to said tool shaft, said motor driving said coupling to cause it to rotate in said "normal" direction so that friction of said shaft in said pivot element tends to drive and hold said lower sleeve in abutment against said bending end in the absence of rotation of the drilling string.

Said member in friction contact against the wall of the well below the bending device and above the drilling tool is advantageously a stabilizer for maintaining the string on the axis of the well, thereby guiding the tool.

Said pivot means are constituted by a pivot which is generally in the shape of an elongate tube about said pivot axis with a side surface constituting guide bearings which are cylindrical bodies of revolution about said axis and which cooperate with the inside surface of a housing formed in a moving one of said sleeves in order to guide said moving sleeve in rotation, said pivot also including a retaining shoulder cooperating with an internal shoulder on said sleeve to prevent axial displacement thereof and to maintain contact with the other one of said sleeves which constitutes a fixed sleeve, said pivot further including retaining means and angular abutment means for fixing it inside said fixed sleeve, said pivot or said moving sleeve finally including a projection which extends into a hollow angular sector in said moving sleeve or said pivot, respectively, to enable said rotation of said lower sleeve relative to said upper sleeve through a limited angular sector.

The present invention also provides a method of drilling a well with bends, said method using a drilling string as defined above:

said drilling string being continuously rotated in said "normal" direction from the surface of the ground during rectilinear drilling stages in order to maintain said lower sleeve in abutment against said alignment end of said pivot sector (R);

the changeover from a rectilinear drilling stage to a curved drilling stage comprising the following steps:

the drilling string is temporarily rotated in said opposite direction from the surface of the ground in order to bring said lower sleeve into abutment against said bending end of said pivot sector; and the angular position of the bottom end of the drilling string about its axis is measured and said string continues to be rotated in said opposite direction until said axis arrives in a predetermined plane of curvature in which a curved length of well is to be drilled;

said curved drilling stage then being performed without the string being rotated; and the changeover from a curved drilling stage to a rectilinear drilling stage being performed by returning to rotation of the drilling string in the normal direction.

In this method, it is preferable when changing over from a a rectilinear drilling stage to a curved drilling stage after said limited rotation of the drilling string in said opposite direction, to include an untwisting step with the drilling string being rotated during said untwisting step in the normal direction in order to prevent the resilient torsion couple which appears in the string from subsequently driving the axis of said lower sleeve beyond said plane of curvature.

BRIEF DESCRIPTION OF THE DRAWINGS

An embodiment of the invention is described by way of example with reference to the accompanying drawings, in which.

It should be understood that the items described as shown may be replaced by other items which perform the same technical functions and without going beyond the scope of the invention. When the same item appears in several of the figures, it is given the same reference symbol in each of them.

MORE DETAILED DESCRIPTION

Figure 1:
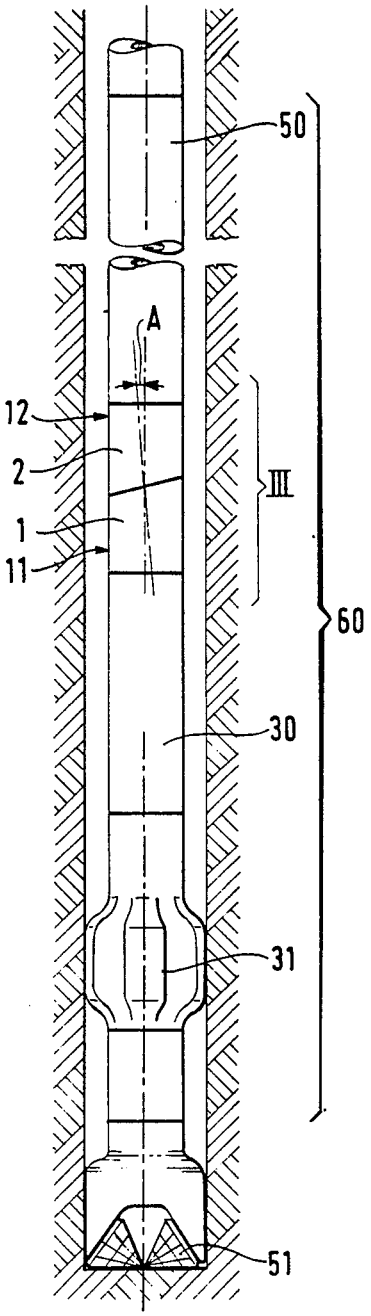
FIG. 1 is an elevation view of the bottom portion of a drilling string in accordance with the invention and during a rectilinear drilling stage.

As shown in FIG. 1, the bottom portion of a generally cylindrical drilling string is rotated at low speed (e.g. at 80 r.p.m.) from the ground in a "normal" direction, in such a manner as to facilitate the downwards movement of the string as the drilling tool 51 does its work.

Drilling mud is injected along the string of stems from the surface of the ground. As it moves downwardly, the mud passes successively through:

a down-hole motor, or more precisely the active element 50 of a motor for driving the drilling tool 51 in rotation and receiving mud under pressure for that purpose; the motor may advantageously be of conventional type known under the term "Moineau" motor and it may operate at 300 r.p.m., for example, as does the tool 51;

a tubular bending device 1, 2 in accordance with the invention is disposed in a rectilinear configuration in FIG. 1, thereby having the shape of a rectilinear tube which is coaxial with the string, i.e. which does not set up a bend at this stage of drilling;

a pivot element (or cartridge) 30 for supporting the axial forces on the motor 50 and the tool 51 while allowing them to rotate at high speed;

a stabilizer 31 having fins disposed in radial axial planes and projecting radially outwardly to maintain the string in the axis of the bore; and the drilling tool 51.

Reference 60 designates the "driving assembly" comprising the motor per se, the pivot cartridge 30, and the stabilizer 31.

The mud leaving via the drilling tool 51 rises in conventional manner around the drilling string back up to the surface of the ground and serves to entrain rock debris formed by operation of the tool.

Figure 2:
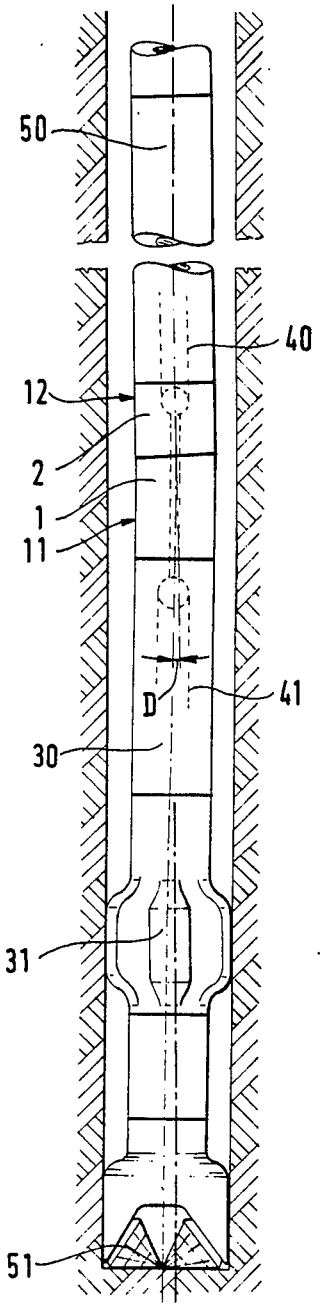
FIG. 2 is an elevation view of the same portion of the same drilling string during a curved drilling stage, i.e. while the bore of the well is being bent.

The same portion of the string is shown in FIG. 2 except insofar as the bending device in accordance with the invention is shown in its bent configuration for drilling curved length of well.

Figure 3:
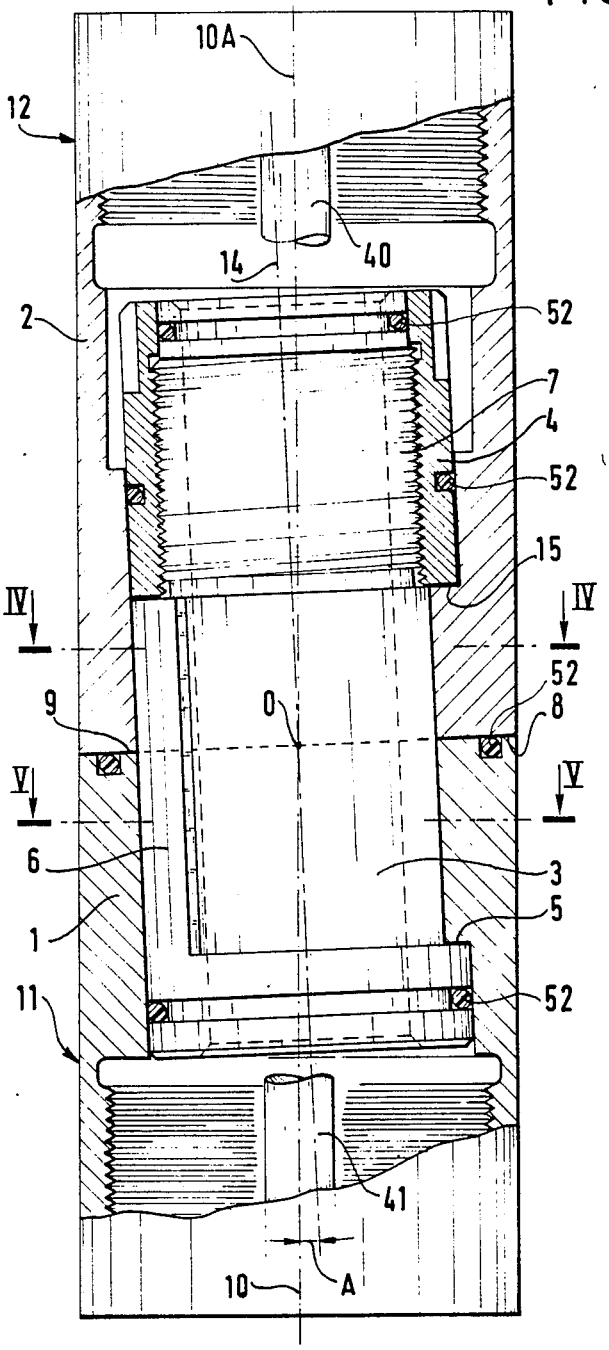
FIG. 3 is a view on a larger scale of a portion III of the FIG. 1 string, said string being shown in section on a plane passing through its axis and showing a device in accordance with the invention, and with the pivot of said device not being in section.
Figure 4:
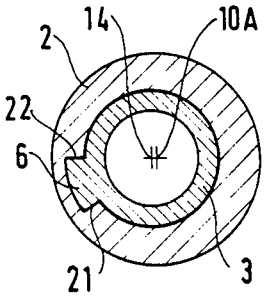
FIGS. 4 and 5 are two views of the same portion of the FIG. 3 string shown in section on two planes perpendicular to the axis of said string, and respectively marked IV—IV and V—V in FIG. 3.
Figure 5:
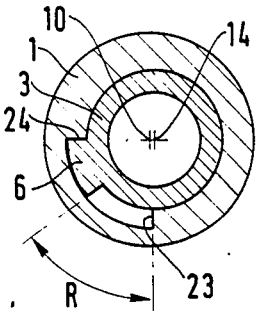

FIG. 3 shows the bending device in accordance with the invention to larger scale and in its rectilinear configuration. This device embodies the above-specified characteristics of the invention and, in particular, it comprises:

a bottom sleeve 1 whose bottom end is suitable for coaxially receiving the pivot cartridge 30 and whose top end includes arrangements suitable for receiving a pivot 3;

a top sleeve 2 whose top end is suitable for coaxially receiving the motor element 50 and whose bottom portion has arrangements suitable for receiving the pivot 3;

a tubular pivot 3 which comprises a bottom shoulder 5, a key 6, and a threaded top end 7;

a lock nut 4 co-operating with the threaded end 7 to press the sleeves 1 and 2 against each other between said shoulder 5 and said nut; and sealing rings 52 for preventing drilling mud from infiltrating between rubbing surfaces.

Plane end faces 8 and 9 of the sleeves 1 and 2 respectively abut against each other. These faces slope relative to the common axis 10, 10A of the outside surfaces 11 and 12 of said sleeves. The plane of these faces intersects the axis 10 at a point O and is at a very small angle to the plane passing through the point O perpendicularly to the axis 10. The axis 14 passing through point O is also the axis of the pivot 3 and lies at a very small angle A relative to the axis 10, said angle lying in the range 0° to 10°, for example.

The coupling is ready for use when the nut 4 is locked to the pivot 3 and its face 15 and shoulder 5 are pressed tight against the faces of the corresponding housings machined in the sleeves 1 and 2.

The key 6 of the pivot 3 is caused to fit inside the sleeve 2 and to bear against faces 21 and 22 therein.

However, when the pivot rotates, it moves between end faces 23 and 24 of a housing in the form of a wider angular sector machined in the sleeve 1. Its pivot angle constitutes the above-mentioned angular pivot sector.

During rectilinear drilling, the sleeve 2 is rotated clockwise in the direction specified above as being "normal". The sleeve 1 which is connected to the pivot cartridge 30 which is itself provided with a stabilizer 31, is slowed down by friction between the stabilizer 31 and the ground.

Driving the sleeve 2 causes the pivot 3 to be driven by means of the key 6. The key thus presses against the face 24 of the angular sector machined in the sleeve. In this position the axes 10 and 10A coincide.

When a few turns are performed in the opposite direction, friction between the stabilizer 31 and the ground opposes such movement. The sleeve 2 thus drives the pivot 3 and hence rotates the key 6 so that it comes into contact with the opposite end face 23. This relative angular rotation takes place about the sloping axis 14 of the pivot 3 with the faces 8 and 9 sliding over each other. As a consequence of such rotation through an angle R, the axes 10 and 10A are no longer in alignment, but are at an angle D where:

$$D=2\,A\sin R/2$$

For example, if the housing 23–24 is machined so that R=60°, D=A.

It can be seen from the above equation that the bend or deflection angle D through the coupling depends on the values selected for two variables A which is the pivot slope angle and R which is the pivot sector angle.

Since the axes 10 and 10A are no longer in alignment, the motion transmission shafts 40 and 41 contained in and guided by the sleeves 50 and 30 are themselves no longer in alignment. Consequently, the bent coupling includes a universal joint 39, e.g. of the Cardan type, for transmitting torque from the motor element 50 to the tool 51 while still allowing the shafts 40 and 41 of the motor element and the pivot cartridge to slope relative to each other. In this configuration, the angle between the two sleeves thus serves to perform a bending operation, after conventional pointing operations have been performed.

It should be observed that although positive displacement motors of the Moineau type are particularly suitable for use with this type of coupling, the coupling may also be used without difficulty with turbine-type motors.

Once a bending operation has been performed and checked, a return to rectilinear drilling can readily be performed by directly rotating the string in the opposite direction.

It appears that a device in accordance with the invention makes it possible to combine in a single well the advantages of using a bent string and the advantages of the method in which rectilinear drilling results from rotating an excentric stabilizer, while avoiding the drawbacks thereof. It also makes it possible to perform each of the two operations in the configuration which is best adapted to each of them.

It appears to be particularly advantageous when performing "correction" bends as mentioned above.

I claim:

1. In a drilling string assembly for drilling a bent bore, said string assembly having an axis at all points along its length and comprising:

a rotary drilling tool mounted via a tool shaft to the bottom of the string, said tool having a tool axis which locally constitutes the string assembly axis;

a down-hole motor assembly including a driving element driving said tool in rapid rotation relative to said string assembly;

a pivot element placed between said driving element and said tool and carrying said tool shaft for transmitting axial thrust to said tool while enabling said tool rotation;

a controllable bending device above said tool capable of taking up a bent configuration for locally bending the string in order to provide a curved length of bore, and capable of taking up a rectilinear configuration for re-establishing string rectilinearity in order to provide a straight length of bore; and a succession of drilling tubes for transmitting axial thrust to said pivot element, and for enabling the string assembly to be slowly rotated from the surface of the ground;

said bending device comprising:

a lower sleeve having an axis which is locally the axis of said string assembly and which is fixed to said tool axis;

an upper sleeve above said lower sleeve and having an axis which is locally the axis of said string assembly; and pivot means interconnecting said upper and lower sleeves, said pivot means having a pivot axis which slopes by the same small pivot slope angle (A) relative to the respective axes of said sleeves and holding said sleeves relative to each other and a pivot sector enabling the lower sleeve to rotate through a limited pivot sector angle (R) relative to the upper sleeve about said pivot axis, between an aligned position of said lower sleeve in which the axes of said sleeves are aligned in order to bring said device to its rectilinear configuration, and a bent position of said sleeve creating a bend angle D where; $D=2\,A\sin R/2$ between the axes of said two sleeves bringing the device its bent configuration, said pivot means allowing a free passage inside the string assembly at least for a drilling mud;

the improvement wherein said column includes, beneath said bending device and above said tool, a member which rubs against the wall of the bore so that rotating said drilling string assembly in a normal direction causes a friction couple to be set up bringing said lower sleeve into abutment at said alignment end of the pivot sector, and so that rotation of said drilling string assembly in the opposite direction causes a friction couple to be set up bringing said lower sleeve into abutment at said bending end, and said bending device is placed between said driving element and the pivot element and has a coupling passing axially therethrough for transmitting motor drive to said tool shaft, said driving element driving said coupling to cause it to rotate in said "normal" direction so that friction of said shaft in said pivot element tends to drive and hold said lower sleeve in abutment at said bending end in the absence of rotation of the drilling string assembly.

2. A drilling string according to claim 1, wherein said member in friction contact against the wall of the well below the bending device and above the drilling tool is a stabilizer for maintaining the string on the axis of the well.

3. A method of drilling a well with bends using a drilling string, said string having an access of all points along its length and comprising:

a rotary tool mounted via a tool shaft to the bottom of the string, said tool having a tool axis which locally constitutes the string assembly axis;

a down-hole motor assembly including a driving element driving said tool in rapid rotation relative to said string assembly;

a pivot element placed between said driving element and said tool and carrying said tool shaft for transmitting axial thrust to said tool while enabling said tool rotation;

a controllable bending device above said tool capable of taking up a bent configuration for locally bending the string in order to provide a curved length of bore, and capable of taking up a rectilinear configuration for re-establishing string rectilinearity in order to provide a straight length of bore; and a succession of drilling tubes for transmitting axial thrust to said pivot element, and for enabling the string assembly to be slowly rotated from the surface of the ground;

said bending device comprising:

a lower sleeve having an axis which is locally the axis of said string assembly and which is fixed to said tool axis;

an upper sleeve above said lower sleeve and having an axis which is locally the axis of said string assembly; and pivot means interconnecting said upper and lower sleeves, said pivot means having a pivot axis which slopes by the same small pivot slope angle (A) relative to the respective axes of said sleeves and holding said sleeves relative to each other and a pivot sector enabling the lower sleeve to rotate through a limited pivot sector angle (R) relative to the upper sleeve about said pivot axis, between an alignment end position of said lower sleeve in which the axes of said sleeves are aligned in order to bring said device to its rectilinear configuration, and a bending end position of said sleeve creating a bend angle D where; $D=2A \sin R/2$ between the axes of said two sleeves bringing the device its bent configuration, said pivot means allowing a free passage inside the string assembly at least for a drilling mud;

and wherein said column includes, beneath said bending device and above said tool, a member which rubs against the wall of the bore, said method comprising the steps:

continuously rotating said drilling string in a "normal" direction from the surface of the ground during rectinlinear drilling stages in order to maintain said slower sleeve in abutment against said alignment of said pivot sector; and effecting a change over from a rectilinear drilling stage to a curved drilling stage by temporarily rotating the drilling string in said opposite direction from the surface of the ground in order to bring the lower sleeve into abutment against said bending end of said pivot sector;

measuring the angular position of the bottom end of the drilling string about its axis and continuing to rotate said string in the opposite direction until said axis arrives in a predetermined plane of curvature in which a curved length of well is to be drilled;

performing said curved drilling stage without the string being rotated; and effecting a changeover from a curved drilling stage to a rectilinear drilling stage by returning the rotation of the drilling string to rotation in the normal direction.

4. The method according to claim 3 further comprising the step of untwisting when passing from a rectilinear drilling stage to a curved drilling stage after a limited rotation of the drilling string insaid opposite direction with the drilling by rotating the drilling string during said untwisting step in the normal direction in order to prevent the resilient torsion couple which appears in the string from subsequently driving the axis of the lower sleeve beyond said plane of curvature.

* * * * *